United States Patent [19]

Kitada et al.

[11] Patent Number: 4,815,419

[45] Date of Patent: Mar. 28, 1989

[54] ENGINE COOLING APPARATUS

[75] Inventors: Taizo Kitada; Yoshiaki Danno; Mituru Kishimoto; Atsuo Sato, all of Kyoto; Nobuaki Shimizu, Kameoka; Yoshinari Fukami; Masazi Asada, both of Kyoto, all of Japan

[73] Assignees: Mitsubishi Jidosha Kogyo Kabushiki Kaisha; Nippon Jidosha Engineering Kabushiki Kaisha, both of Tokyo, Japan

[21] Appl. No.: 111,612

[22] Filed: Oct. 23, 1987

[30] Foreign Application Priority Data

Oct. 23, 1986 [JP] Japan ..... 61-162535[U]
Oct. 23, 1986 [JP] Japan ..... 61-162536[U]
Oct. 29, 1986 [JP] Japan ..... 61-166161[U]

[51] Int. Cl.[4] ..... F01P 3/02

[52] U.S. Cl. ..... 123/41.42; 123/41.74; 123/41.84

[58] Field of Search ..... 123/41.29, 41.42, 41.72, 123/41.74, 41.83, 41.84

[56] References Cited

U.S. PATENT DOCUMENTS

| | | | |
|---|---|---|---|
| 1,749,683 | 3/1930 | Windhoff | 123/41.42 |
| 2,085,810 | 7/1937 | Ljungstrom | 123/41.42 |
| 3,127,879 | 4/1964 | Giacosa et al. | 123/41.42 X |
| 4,348,991 | 9/1982 | Stang et al. | 123/41.42 X |

*Primary Examiner*—Tony M. Argenbright
*Attorney, Agent, or Firm*—Oblon, Fisher, Spivak, McClelland & Maier

[57] ABSTRACT

An engine cooling apparatus separately cools a cylinder head and a cylinder block which are positioned around upper and lower portions of an engine combustion chamber. For increased engine output power, the engine cooling system cools the cylinder head to a relatively low temperature and the cylinder block to a relatively high temperature. The cylinder block includes cylinder liners disposed in an oil jacket which is supplied with oil from an oil circulating system via a pressure reducing valve. Oil in the oil jacket returns through a return path into an oil reservoir in the engine, and air bubbles in the oil jacket are returned to the oil reservoir via an air bubble return passage which develops a pressure difference between its opposite open ends.

5 Claims, 9 Drawing Sheets

ENGINE COOLING APPARATUS

BACKGROUND OF THE INVENTION

The present invention relates to an engine cooling apparatus, and more particularly to an engine cooling apparatus having at least two engine cooling systems around a combustion chamber of an engine.

If the temperature of a combustion chamber of an engine were too high, knocking would frequently be caused, and the intake charging efficiency would be lowered, resulting in a reduction in the engine output power. Since the valve operating system in a cylinder head produces frictional heat, it is generally desirable that the upper portion of the combustion chamber be cooled to a relatively low temperature. On the other hand, the side and lower portion of the combustion chamber nera the cylinder block should preferably be cooled to a relatively high temperature. More specifically, the mutually sliding surfaces of the combustion chamber and the piston and the mutually sliding surfaces of the bearings of the crankshaft produce frictional heat due to their fitting engagement and dependent on how oil films are formed on these sliding surfaces. It is better to keep the sliding surfaces at a relatively high temperature for reducing the frictional resistance and hence minimizing any reduction in the engine output power.

Japanese Laid-Open Patent Publication No. 51-124749, for example, shows an engine cooling arrangement in which the cylinder head is cooled by cooling water of a relatively low temperature and the cylinder block is cooled by cooling water of a relatively high temperature. Inasmuch as the cooling water starts to boil and produce air bubbles normally at about 100° C., there is a limitation on relatively high temperatures up to which the side portions of the cylinder block are kept by the cooling water. Improvements remain to be made in this respect.

SUMMARY OF THE INVENTION

It is therefore an object of the present invention to provide an engine cooling apparatus capable of allowing engine output power to be increased easily.

Another object of the present invention is to provide an engine cooling apparatus which can prevent air bubbles contained in oil in an oil jacket from lowering the cooling capability.

An engine cooling apparatus according to the present invention has an upper cooling system, an oil jacket, an oil circulating system, a pressure reducing means, a return path, and an air bubble return passage.

The upper cooling system has a flow passage for circulating a cooling fluid, the flow passage being defined in a cylinder head or between the cylinder head and an upper portion of a cylinder block. The flow passage may be a water jacket for circulating cooling water.

The oil jacket defines a closed space around cylinder liners of the cylinder block. The closed space is formed by the cylinder liners and opposite covers disposed outside of the cylinder liners. The closed space forms part of the oil circulating system and is connected to a higher-pressure portion of the oil circulating system through the pressure reducing menas and also to an oil reservoir through the return path.

The oil jacket has an upper end surface continuously extending in the longitudinal direction of the engine.

The upper end surface may extend substantially longitudinal or may be inclined in the longitudinal direction of the engine, with one end of the air bubble return passage opening into a highest portion of the inclined upper end surface. The cylinder liners have a flange serving as the upper end surface of the oil jacket. The flange may extend substantially horizontally or may flare outwardly in the upwardly direction.

The oil circulating system has a flow passage for supplying oil from the oil reservoir to various parts of the engine. The flow passage has the higher-pressure portion with which there communicate the pressure-reducing means, the oil jacket, the return path, and the oil reservoir.

The pressure reducing means serves to reduce the pressure of oil in the higher-pressure portion of the oil circulating system and supply lower-pressure oil to the oil jacket.

The return path provides communication between an upper portion of the oil jacket and the oil reservoir. The return path may be vertically elongate and integrally formed in one of the covers. The return path may be of one of various widths. For example, where the pressure reducing means communicates with one side of the oil jacket in the transverse direction of the engine and one end of the air bubble return passage communicates with the other side of the oil jacket at opposite ends thereof in the longitudinal direction of the engine, the return path is of a width large enough to double as an air bubble return passage.

The air bubble return passage has one end opening into an upper area of the oil jacket and the other end opening into the oil reservoir for developing a pressure difference between these opposite ends. The air bubble return passage is positioned for removing air bubbles produced in the oil jacket. For example, one end of the air bubble return passage may be opened into the highest portion of the upper end surface of the oil jacket. The air bubble return passage may be disposed in one side of the oil jacket in the transverse direction of the engine, whereas the return path may be disposed in the other side of the oil jacket. The return path and the air bubble return passage may be integrally formed in the cylinder head.

The engine cooling apparatus of the present invention employs oil as a cooling fluid for the lower portion of the combustion chamber in separately cooling the upper and lower portions of the combustion chamber. Therefore, the lower portion of the combustion chamber can be cooled to a relatively high temperature for producing increased engine output power. Air bubbles produced in the oil jacket can be discharged through the air bubble return passage or through the air bubble return passage and the return path. Therefore, a reduction of the cooling capability which would otherwise be brought about by the air bubbles can be prevented. This also results in increased engine output power.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

An engine cooling apparatus according to an embodiment of the present invention will be described with reference to FIGS. 1 through 4.

FIGS. 1 through 4 illustrate an engine cooling apparatus incorporated in a 4-cycle DOHC in-line 4-cylinder internal combustion engine.

Figure 1:
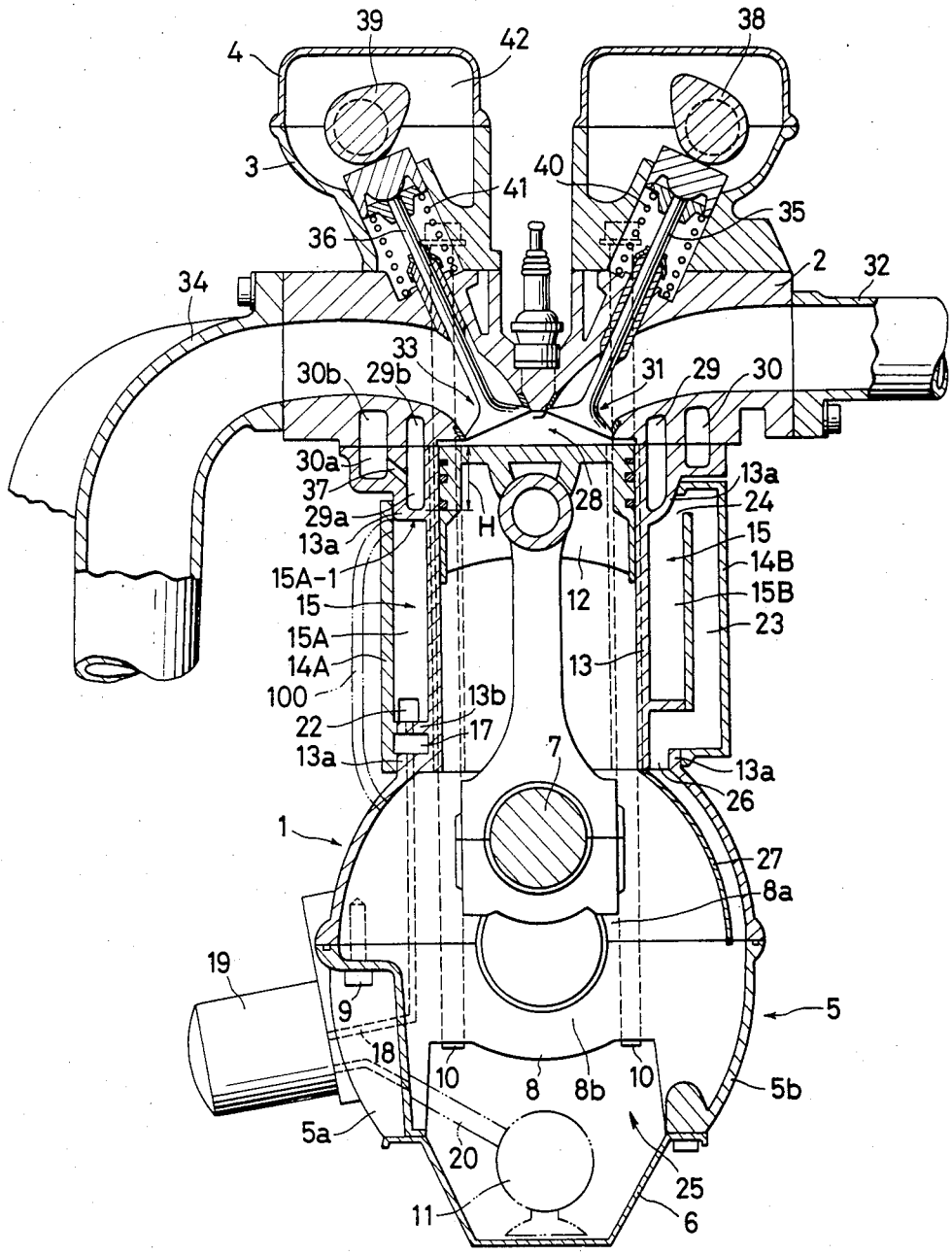
FIG. 1 is a cross-sectional view of an engine cooling apparatus according to an embodiment of the present invention.
Figure 2:
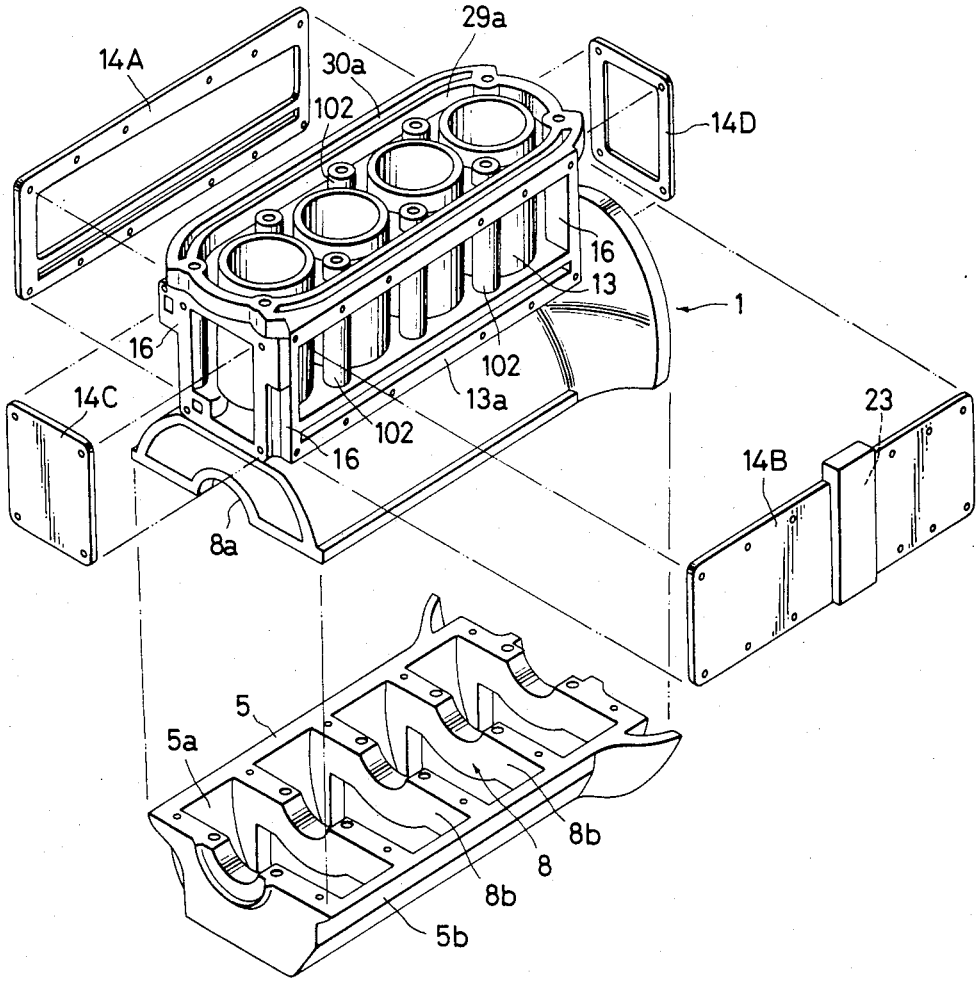
FIG. 2 is an exploded perspective view of major components of the engine cooling apparatus shown in FIG. 1.

As shown in FIGS. 1 and 2, the engine comprises a cylinder block 1, a cylinder head 2 mounted on the top of the cylinder block 1, an upper cylinder head member 3 mounted on the top of the cylinder head 2, a cylinder head cover 4 mounted on the top of the upper cylinder head member 3, a crank cover 5 mounted on the bottom of the cylinder block 1, and an oil pan 6 attached to the bottom of the crank cover 5.

A crankshaft 7 elongate in the longitudinal direction (normal to the sheet of FIG. 1) of the engine is disposed centrally in a lower portion of the cylinder block 1. The crankshaft 7 is rotatably supported by a plurality of bearings 8 in the cylinder block 1 and the crank cover 5. Each of the bearings 8 comprises an upper member 8*a* integral with the bottom of the cylinder block 1 and a lower member 8*b* integral with the crank cover 5 in vertical alignment with the upper member 8*a*. The crank cover 5 is in the form of a ladder (see FIG. 2) including laterally spaced skirts 5*a*, 5*b* and the lower bearing members 8*b* extending between the skirts 5*a*, 5*b* and spaced at regular intervals in the longitudinal direction of the crank cover 5. The crank cover 5 has its peripheral edges fastened to the cylinder block 1 by means of a plurality of bolts 9 (FIG. 1). The upper members 8*a* and the lower members 8*b* of the crankshaft bearings 8 are secured together by means of through bolts 10.

The crank cover 5 has a downward opening closed by the oil pan 6 which houses therein an oil pump 11 for supplying lubricating oil in the oil pan 6 to various components of the engine. The oil pump 11 is driven by the crankshaft 7 through a chain and sprockets (not shown).

The cylinder block 1 has an array of four vertical cylinder liners 13 serving as inner wall members or cylinders housing vertically slidable pistons 12, respectively. Lateral, front and rear plate-like covers 14A, 14B, 14C, 14D as outer wall members are attached to the cylinder block 1 in covering relation to the liners 13. The liners 13 and the covers 14A through 14D jointly define a closed oil jacket 15. As illustrated in FIG. 2, the cylinder block 1 has columns 16 positioned at respective four corners surrounding the liners 13. The covers 14A through 14D are bolted to the columns 16 and upper and lower flanges 13*a* of the liners 13 through gaskets (not shown). The oil jacket 15 is thus formed as a closed space defined between the liners 13 and the covers 14A through 14D.

As shown in FIG. 1, a lateral ridge 13*b* is formed on the lower ends of the liners 13 at their lefthand sides above the lower flange 13*a*, the ridge 13*b* being elongate in the longitudinal direction of the engine. The ridge 13*b* has its distal edge held closely against the inner wall surface of the cover 14A. The ridge 13*b* divides the space on the lefthand side of the liners 13 into an upper oil jacket 15 and a lower oil gallery 17. The oil jacket 15 and the oil gallery 17 are part of a lower oil circulating system 43 (see FIG. 4). The oil gallery 17 is held in communication via a high-pressure oil passage 18 defined in a lower wall of the cylinder block 1 and the crank cover 5, an oil cleaner 19 mounted on an outer side of the crank cover 5, and a high-pressure oil pipe 20 with the outlet port of the oil pump 11. The oil gallery 17, the oil passage 18, the oil cleaner 19, and the oil passags 20 jointly constituting a higher-pressure portion of the lower oil circulating system 43. The ridge 13*b*, which serves as the upper wall of the oil gallery 17, supports thereon a check valve 22 serving as a pressure reducing means and communicating with the oil gallery 17. The check valve 22 is effective to lower a high oil pressure in the oil gallery 17 by a prescribed pressure, and introduces oil from the oil gallery 17 into the oil jacket 15 containing lower-pressure oil.

Figure 3:
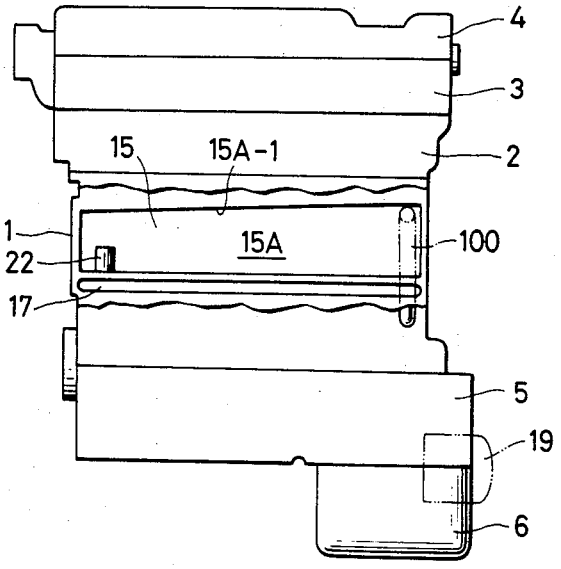
FIG. 3 is a schematic side elevational view of the engine cooling apparatus shown in FIG. 1.

The oil jacket 15 includes an oil jacket portion 15A which is disposed on one side of the liners 13 transversely of the engine and into which oil flows from the oil gallery 17 through the check valve 22. The oil jacket portion 15A has an upper end surface 15A-1 inclined in the longitudinal direction of the engine as shown in FIG. 3 such that the upper end surface 15A-1 is lowest at its portion above the check valve 22 and becomes progressively higher in a direction away from the check valve 22. Therefore, when oil flows through the check valve 22 into the oil jacket portion 15A, air bubbles contained in the oil are collected into an upper area of the oil jacket portion 15A and moved obliquely upwardly along the upper end surface 15A-1 toward the highest area of the oil jacket portion 15A, which is positioned near an upper edge of the cover 14A.

A return pipe 100 (FIG. 3) serving as an air bubble return passage has an end opening through a nipple or the like into the highest area of the oil jacket portion 15A where air bubbles are collected. The other end of the return pipe 100 communicates through the bottom of the cylinder block 1 with a crank chamber 25 defined in the lower portion of the cylinder block 1 and the crank cover 5. The return pipe 100 has an inside diameter selected such that a prescribed pressure difference will be developed between the pressure in the oil jacket 15 and the pressure (approximately atmospheric pressure) in the crank chamber 25. The return pipe 100 may have an orifice therein.

The air trapped in the oil jacket 15 flows, together with oil in the oil jacket 15, back into the crank chamber 25 via the return pipe 100. Therefore, the air bubbles floating into the upper area of the oil jacket 15 and collected into the highest area thereof do not remain in the oil jacket 15 but are removed through the return pipe 100.

As shown in FIG. 1, the oil jacket 15 also has a right-hand oil jacket portion 15B defined partly by an outer side wall composed of the cover 14B. The cover 14B has a vertically elongate return path 23 defined by a member integrally formed with the cover 14B on its central portion. The return path 23 provides communication between an overflow port 24 opening into an upper area of the oil jacket 15 and a return port 26 opening into an upper area of the crank chamber 25. A curved member 27 is disposed in the crank chamber 25 below the return port 26 for allowing oil from the return port 26 to smoothly flow into the oil pan 6 below. Therefore, oil supplied from the oil gallery 17 into the oil jacket 15, except for the oil which flows with air bubbles via the return pipe 100 back into the crank chamber 25, overflows into the overflow port 24 and back to the oil pan 6. Therefore, oil circulated through the oil jacket 15 while a predetermined amount of oil remains kept in the oil jacket 15.

The cylinder head 2, the cylinder block 1, and each piston 12 jointly define a combustion chamber 28 which is surrounded two upwardly opening annular grooves **29*a*, 30*a* defined in the upper edge of the cylinder block 1. The inner annular groove 29*a* extends from the upper end of the cylinder block 1** downwardly by a length H.

The cylinder head 2 which provides an upper peripheral wall of the combustion chamber 28 has intake ports 31 and exhaust ports 33 for the respective combustion chambers 28, the intake ports 31 communicating with an intake manifold 32 and the exhaust ports 33 communicating with an exhaust manifold 34. Intake and exhaust valves 35, 36 are movably disposed in the intake and exhaust ports 31, 33, respectively. The cylinder head 2 also has two downwardly opening annular grooves **29*b*, 30*b* defined in the lower edge thereof in vertical registry with the annular grooves 29*a*, 30*a* in the cylinder block 1. The annular grooves 29*a*, 29*b* jointly define a water jacket 29, and the annular grooves 30*a*, 30*b* jointly define an outer water gallery 30. The water jacket 29 extends upwardly in surrounding relation to the intake port 31 and the exhaust port 33**.

Figure 4:
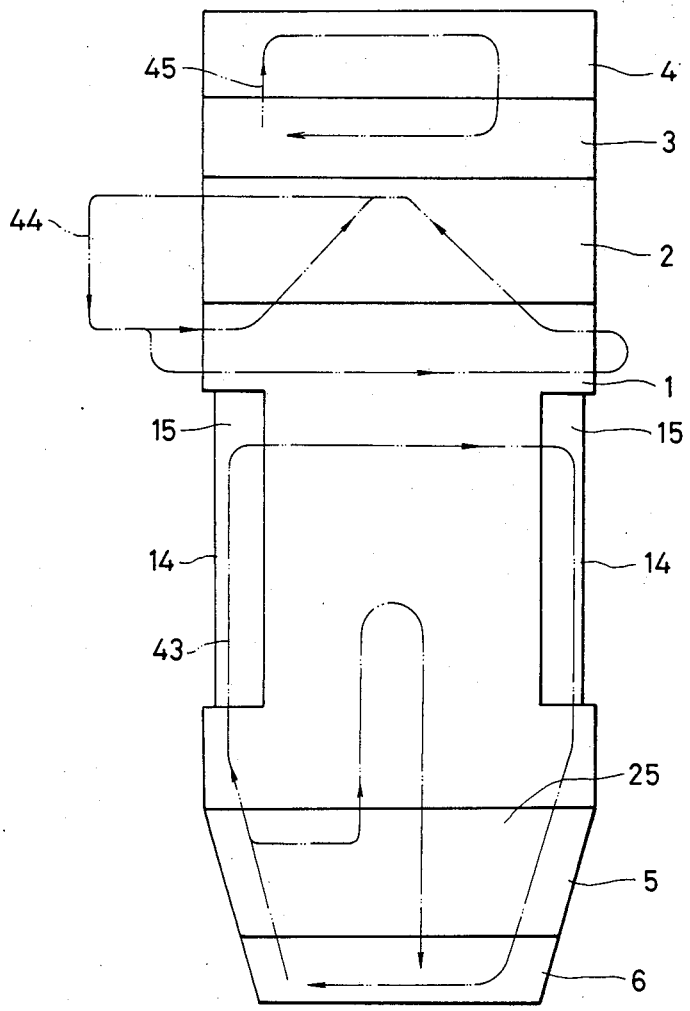
FIG. 4 is a schematic view of a three-part cooling system of the engine cooling apparatus shown in FIG. 1.

The water gallery 30 and the water jacket 29 are part of a cooling water circulating system 44 (see FIG. 4). The water gallery 30 and the water jacket 29 are held in communication with each other through communication holes 37 of different inside diameters at plural locations. The water gallery 30 is supplied with cooling water discharged by a water pump (not shown) and uniformly supplies the cooling water into the water jacket 29. The water jacket 29 has an outlet port (not shown) for discharging the cooling water via a cooling water pipe (not shown) back to the water pump.

The upper cylinder head member 3, which may be considered to be an upper portion of the cylinder head 2 in a wider sense, accommmodates therein a valve operating system composed of an intake camshaft 38, an exhaust camshaft 39, intake valve springs 40, and exhaust valve springs 41. The bottom wall of the upper cylinder head member 3 has a plurality of holes through which the through bolts 10 extend to securely couple the upper cylinder head member 3, the cylinder head 2, the cylinder block 1, and the crank cover 5. The through bolts 10 extend through respective tubular guide posts 102 (FIG. 2) disposed in the oil jacket 15.

The upper cylinder head member 3 and the cylinder head cover 4 jointly define a camshaft chamber 42 in which parts of the valve operating system such as the camshafts 38, 39 are lubricated and cooled by an upper oil lubricating system 45 (see FIG. 4). More specifically, an oil pump (not shown) is connected to a end of the intake camshaft 38 for supplying oil on the bottom wall of the camshaft chamber 42 to the sliding surfaces of the valve operating system in the camshaft chamber 42.

Operation of the engine cooling apparatus of the aforesaid construction will be described below. The peripheral wall portion of the cylinder head 2 around the upper portion the combustion chamber 28 and the portion of the cylinder head 1 extending the height H downwardly from its upper end are cooled by cooling water circulating in the water jacket 29. At the same time, the portion of the engine cylinder or liner 13 extending around the side and lower portions of the combustion chamber 28, except for the portion of the cylinder head 1 extending the height H downwardly from its upper end, and the crank chamber 25 are cooled and lubricated by oil or a cooling fluid in the lower oil circulating system 43 including the oil jacket 15 and the oil pan 6. The valve operating system is cooled and lubricated by oil in the upper oil circulating system 45.

The upper peripheral wall of the combustion chamber 28 is cooled by the cooling water in the cooling water circulating system 44 to a relatively low temperature to prevent knocking in the engine shown in FIG. 1 and also to reduce expansion of intake air, so that the charging efficiency can be increased. Since the lower portion of the combution chamber 28 is kept at a relatively high temperature by the oil in the lower oil circulating system 43, the sliding surfaces of the liners 13 and the pistons 12 and the sliding surfaces of the crankshaft bearings 8 are kept at a relatively high temperature while forming oil films between these sliding surfaces. Thus, the frictional resistance of the sliding surfaces is greatly reduced. As a result, the engine shown in FIG. 1 can increase its output power. The oil in the oil jacket 15 is less liable to produce air bubbles at high temperatures than water, and hence the liners 13 are less subject to cooling irregularities.

Even if air bubbles are generated in oil as it is introduced into the oil jacket portion 15A and gathered in the upper area of the oil jacket portion 15A, such air bubbles can be removed through the return pipe 100 into the oil pan 6. With the upper end surface 15A-1 of the oil jacket portion 15A being inclined in the longitudinal direction of the engine, as shown in FIG. 3, the air bubbles can easily be collected into the local area of the oil jacket portion 15A and discharged together with oil from the oil jacket portion 15A via the return pipe 100 into the crank chamber 25 and the oil pan 6. Accordingly, the tendency of air bubbles to lower the cooling capability is reliably prevented for sufficient cooling ability.

Inasmuch as oil can overflow into the oil pan 6 through the overflow port 24 located at the highest position in the oil jacket 15, air bubbles can also be removed from the oil jacket 15 via the overflow port 24.

Since the oil jacket 15 is employed in the engine cooling apparatus illustrated in FIG. 1, the oil pan 6 is required to contain a minimum amount of necessary oil, and hence may be reduced in size, with the result that the overall height of the engine can be reduced.

The lower end of the oil jacket portion 15B may have an oil drain hole communicating with the oil pan 6 and openably closed by a drain plug. In this case, when replacing oil, the oil in the oil jacket 15 can quickly be discharged into the oil pan 6 through the oil drain hole by removing the drain plug.

Figure 5:
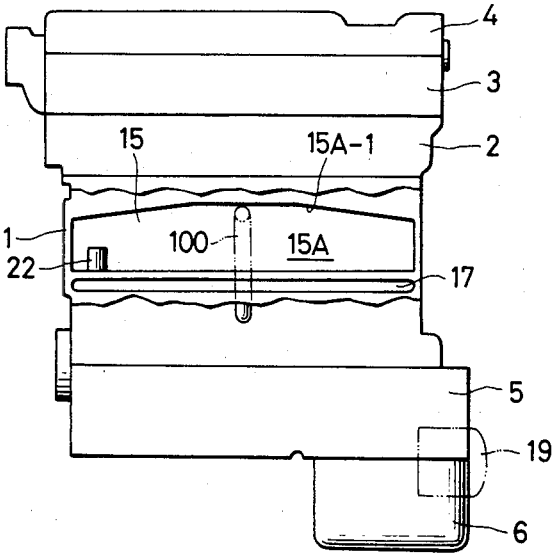
FIG. 5 is a schematic side elevational view of an engine cooling apparatus according to another embodiment of the present invention.
Figure 6:
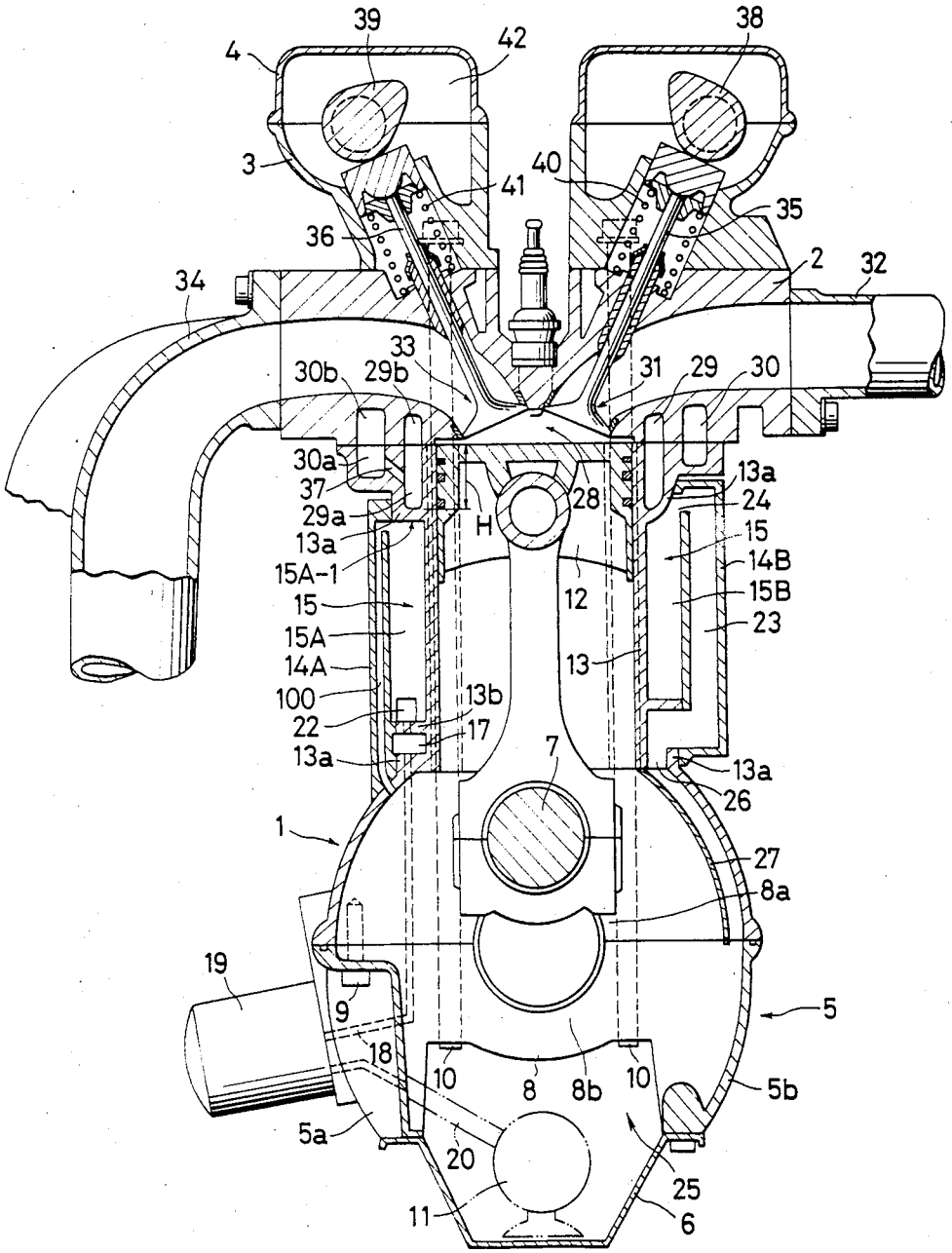
FIG. 6 is a cross-sectional view of an engine cooling apparatus according to still another embodiment of the present invention.

FIGS. 5 and 6 show modifications of the above embodiment. In the embodiment shown in FIG. 1, the upper end surface 15A-1 of the oil jacket portion 15A is inclined over its entire length in the longitudinal direction of the engine. According to the embodiment of FIG. 5, the upper end surface 15A-1 of the oil jacket portion 15A is inclined upwardly and then downwardly in the longitudinal direction of the engine so that the central region of the upper end surface 15A-1 is highest. With this arrangement, air bubbles trapped can be collected into a desired central position in the longitudinal direction of the engine, and a nipple or the like can easily be attached to the upper end surface 15A-1 at such a desired location.

In the embodiment of FIG. 6, the cover 14A has a return pipe 100 defined therein. The return pipe 100 is therefore concealed from external view, and hence the arrangement is compact and of good appearance.

Figure 7:
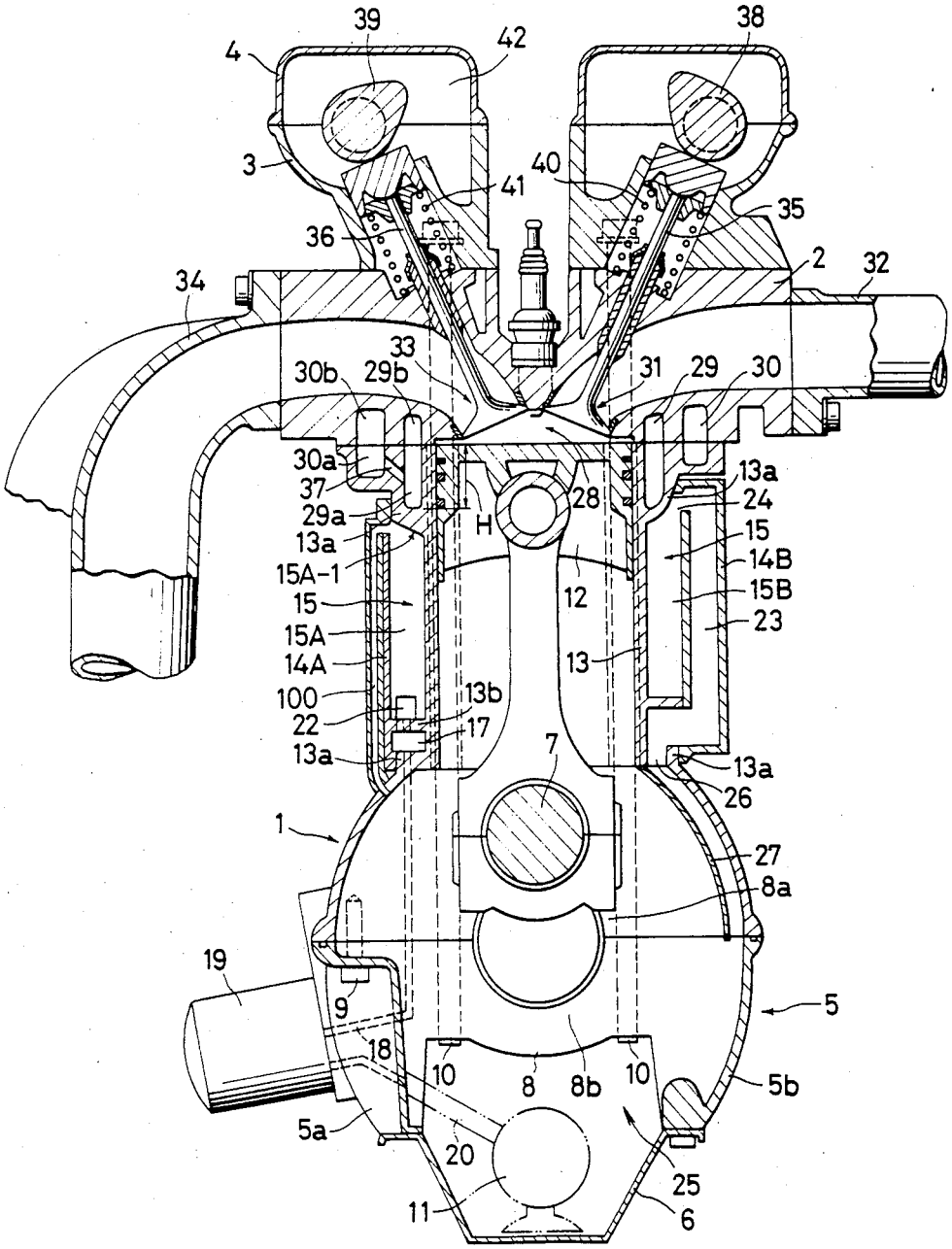
FIG. 7 is a cross-sectional view of an engine cooling apparatus according to a further embodiment of the present invention.

FIG. 7 shows a further embodiment of the present invention. In this embodiment, the upper flange 13*a* of the liners 13 above the oil jacket portion 15A has a lower peripheral surface flaring outwardly in the upward direction, so that the upper end surface 15A-1 of the oil jacket 15A is slanted upwardly in the outward direction.

Air bubbles in oil supplied into the oil jacket portion 15A via the check valve 22 are collected into the upper area of the oil jacket 15A until they reach the upper end surface 15A-1. Since the upper end surface 15A-1 is slanted outwardly, the air bubbles are moved outwardly along the upper end surface 15A-1 away from the liners 13. Accordingly, a reduction in the cooling capability due to the air bubbles can be prevented. Since the air bubbles are returned together with oil from the oil jacket portion 15A through return pipes 100 into the crank chamber 25 and the oil pan 6, the air bubbles do not remain trapped in the upper area of the oil jacket portion 15A. Thus a sufficient cooling capability is assured.

Figure 8:
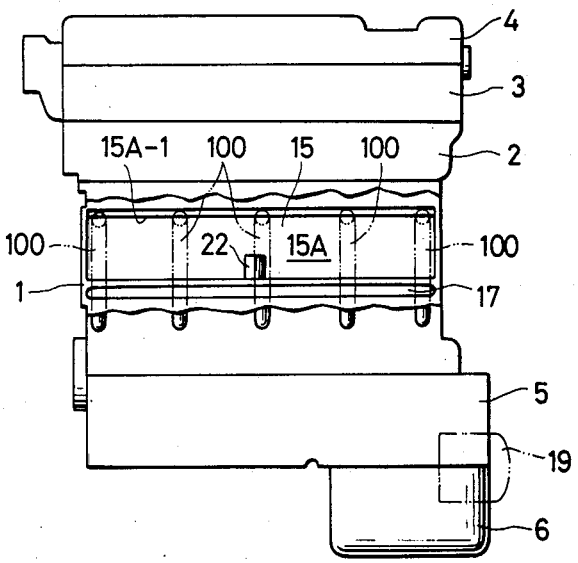
FIG. 8 is a schematic side elevational view of the engine cooling apparatus shown in FIG. 7.

The upper end surface 15A-1 in this embodiment extends substantially horizontally in the longitudinal direction of the engine. Therefore, as shown in FIG. 8, a plurality of return pipes 100 spaced in the longitudinal directon of the engine are provided.

Figure 9:
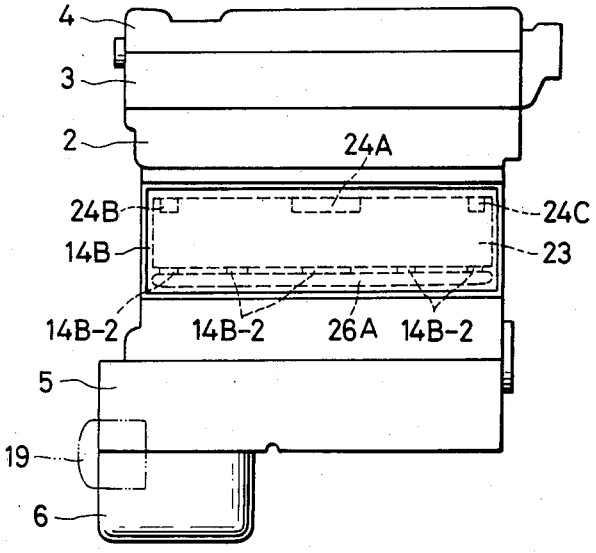
FIG. 9 is a schematic side elevational view of an engine cooling apparatus according to a still further embodiment of the present invention.
Figure 10:
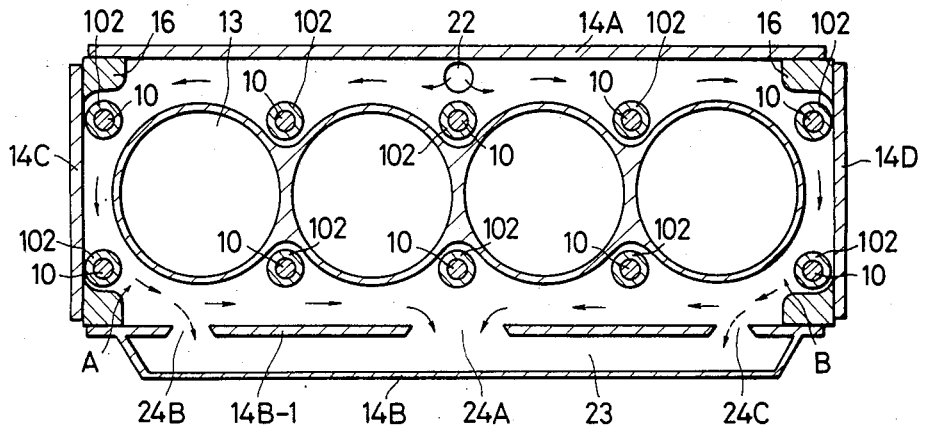
FIG. 10 is a cross-sectional view of the engine cooling apparatus illustrated in FIG. 9.
Figure 11:
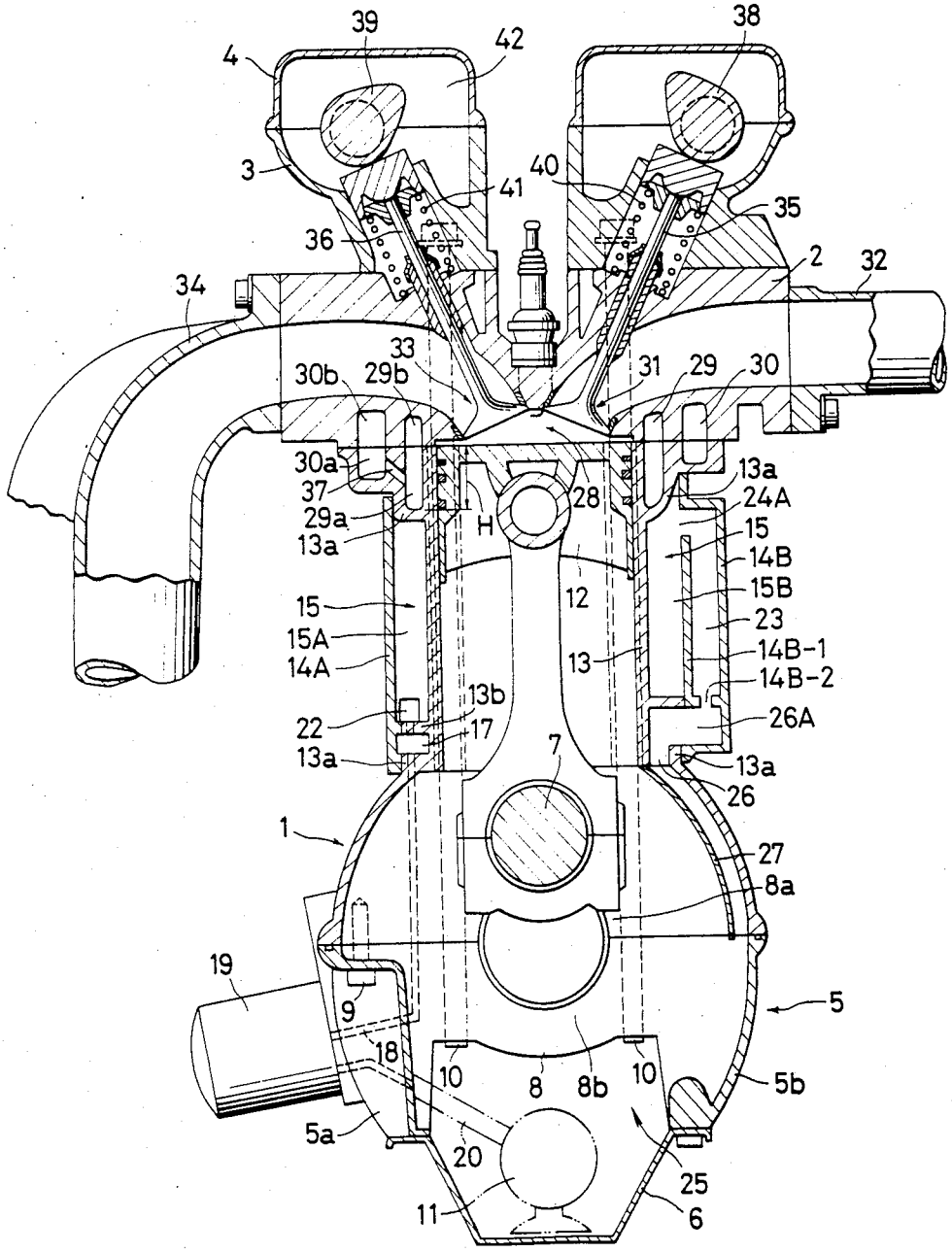
FIG. 11 is a cross-sectional view of the engine cooling apparatus shown in FIG. 9.

FIGS. 9 through 11 show a still further embodiment of the present invention. In the embodiment shown in FIG. 1, the outer side wall of the oil jacket portion 15B from which oil is discharged is provided by the cover 14B, and the return path 23 is defined in the cover 14B. In the embodiment of FIGS. 9 through 11, the cover 14B has a return path 23 defined therein and extending substantially the full width thereof in the longitudinal direction of the engine, as shown in FIG. 10. The return path 23 and the oil jacket 15 communicate with three openings 24A, 24B, 24C defined in an upper edge of a buffle plate 14B-1 which serves as a partition between the return path 23 and the oil jacket portion 15B. The opening 24A is of a larger size and positioned substantially centrally in the longitudinal direction of the buffle plate 14B-1. The opening 24A serves as an oil overflow port. The openings 24B, 24C are of a smaller size and defined in opposite ends of the buffle plate 14B-1 in the longitudinal direction thereof. The openings 24B, 24C are effective in discharging air bubbles which tend to be trapped in the upper area of the oil jacket portion 15B at its opposite ends. The return path 23 has a lower end communicating with an oil gallery 26A through a plurality of communication holes 14B-2. The oil gallery 26A has a return port 26 opening into the upper portion of the crank chamber 25 for allowing smooth drainage of oil into the oil pan 6.

When oil is introduced into the oil jacket portion 15A and flows into the oil jacket portion 15B, any air bubbles trapped in the opposite ends A, B (FIG. 10) of the oil jacket portion 15B can be discharged together with a small amount of oil via the air bubble discharge openings 24B, 24C into the return path 23. Therefore, no air bubbles remain in the opposite ends of the oil jacket portion 15B, and the cooling capability is not lowered by trapped air bubbles.

The air bubbles and the oil discharged therewith are discharged from the return path 23 through the communication communication holes 14B-2 and the oil gallery 26A into the oil pan 6. The return path 23 therefore also serves as an air bubble discharge passage.

The oil in the oil jacket 15 is returned through the overflow port 24A at the hightest position in the oil jacket 15, the return path 23, the communication holes 14B-2, and the oil gallery 26A into the oil pan 6. Accordingly, air bubbles produced in the oil jacket 15 can effectively removed through the air bubble discharge holes 24B, 24C, and can also be discharged quickly from the oil jacket 15 via the overflow port 24A.

Figure 12:
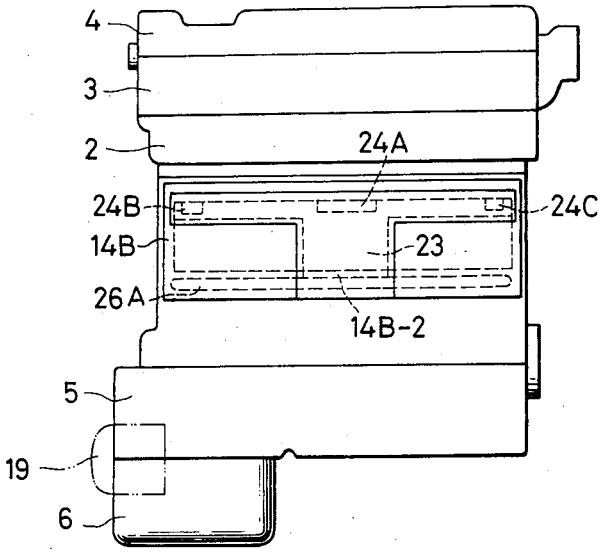
FIG. 12 is a schematic side elevational view of an engine cooling apparatus according to still another embodiment of the preset invention.

FIG. 12 shows a modification of the embodiment shown in FIGS. 9 through 11. In the embodiment of FIG. 12, a single communication hole 14B-2 is defined centrally in the cover 14B to provide communication between the return path 23 and the oil gallery 26A. Air bubbles discharged from the air bubble discharge openings 24B, 24C are collected toward the center of the cover 14B. Such air bubbles and overflow oil from the overflow port 24A are discharged through the single communication hole 14B-2. The arrangement of FIG. 12 is simpler in structure.

Although certain preferred embodiments have been shown and described, it should be noted that various many changes and modifications may be made therein without departing from the scope of the appended claims.

What is claimed is:

1. An engine cooling apparatus in an engine having a cylinder head and a cylinder block including cylinder liners defining cylinders, comprising:

an upper cooling system for cooling the cylinder head;

an oil jacket defined in the cylinder block around the cylinder liners;

an oil circulating system for supplying oil from an oil reservoir in the engine to different parts of the engine, said oil circulating means including a higher-pressure portion;

pressure reducing means coupled to said higher-pressure portion for reducing the pressure of oil from the higher-pressure portion and supplying lower-pressure oil to said oil jacket;

a return path communicating between an upper area of said oil jacket and said oil reservoir; and an air bubble return passage having one end opening into the upper area of said oil jacket and the other end opening into said oil reservoir for developing a pressure difference between said one and other ends of the air bubble return passage.

2. An engine cooling apparatus according to claim 1, wherein said oil jacket has an upper end surface inclined in the longitudinal direction of the engine, said one end of said air bubble return passage opening into a highest portion of said upper end surface.

3. An engine cooling apparatus according to claim 1, wherein said cylinder liners have a flange disposed above said oil jacket and defining an upper end surface of the oil jacket, said flange flaring outwardly in the upward direction.

4. An engine cooling apparatus according to claim 1, wherein said pressure reducing means communicates with one side of said oil jacket in the transverse direction of the engine, said one end of said air bubble return passage opening into the other side of said oil jacket at opposite ends thereof in the longitudinal direction of the engine.

5. An engine cooling apparatus according to claim 1, wherein said return path and said air bubble return passage are integrally formed in said cylinder block.

* * * * *